US007040297B2

(12) United States Patent
Baranowski et al.

(10) Patent No.: US 7,040,297 B2
(45) Date of Patent: May 9, 2006

(54) METHOD FOR CONTROLLING A PIEZO-ACTUATED FUEL-INJECTION VALVE

(75) Inventors: Dirk Baranowski, Regensburg (DE); Lorand D'Ouvenou, Bernhardswald (DE); Hellmut Freudenberg, Grossberg (DE); Christian Hoffmann, Regensburg (DE); Wolfgang Lingl, Kulmain (DE); Richard Pirkl, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 116 days.

(21) Appl. No.: 10/795,015

(22) Filed: Mar. 5, 2004

(65) Prior Publication Data

US 2005/0072854 A1 Apr. 7, 2005

Related U.S. Application Data

(63) Continuation of application No. PCT/DE02/03226, filed on Sep. 2, 2002.

(30) Foreign Application Priority Data

Sep. 5, 2001 (DE) ..... 101 43 501

(51) Int. Cl.
*F02M 37/04* (2006.01)

(52) U.S. Cl. ..... 123/498; 123/478

(58) Field of Classification Search ..... 123/498, 123/478, 299; 239/5, 102.2
See application file for complete search history.

(56) References Cited

U.S. PATENT DOCUMENTS

| | | | | |
|---|---|---|---|---|
| 4,887,569 | A * | 12/1989 | Igashira et al. | 123/300 |
| 6,121,715 | A | 9/2000 | Hoffmann et al. | 310/316.03 |
| 6,236,190 | B1 | 5/2001 | Hoffmann et al. | 320/166 |
| 6,691,682 | B1 * | 2/2004 | Rueger et al. | 123/467 |

FOREIGN PATENT DOCUMENTS

| | | |
|---|---|---|
| DE | 43 08 811 A1 | 1/1994 |
| DE | 199 30 309 A1 | 1/2001 |
| DE | 199 60 971 A1 | 3/2001 |
| DE | 199 30 309 C2 | 12/2001 |
| WO | WO 94/13991 | 6/1994 |
| WO | WO 99/67527 | 12/1999 |

* cited by examiner

*Primary Examiner*—Mahmoud Gimie
(74) *Attorney, Agent, or Firm*—Baker Botts L.L.P.

(57) ABSTRACT

The current guided to the piezo actuator and the voltage which is consequently established thereon is used for calculating with the help of a non-linear actuator model, the characteristics of the longitudinal variations (s) and the force (F) exerted by the actuator (F), and variables therefrom or the derived variables (dF/dt) therefrom determine the beginning of the opening (tA) of a servovalve and the duration of injection (D).

17 Claims, 1 Drawing Sheet s [mm]
t
0
$t_1$
$t_2$
$t_3$
$t_4$
$t_A$
$T_1$
$T_1'$
$T_0$
$T_0'$
$s_1$
$s_0$
W1
W2

F
$F_0$
$F_1$ dF/dt
$dF_1/dt$
$dF_0/dt$
g1
g2
D
$t_5$
$t_6$

METHOD FOR CONTROLLING A PIEZO-ACTUATED FUEL-INJECTION VALVE

CROSS REFERENCE TO RELATED APPLICATION

This application is a continuation of copending International Application No. PCT/DE02/03226 filed Sep. 2, 2002 which designates the United States, and claims priority to German application no. 101 43 501.0 filed Sep. 5, 2001.

TECHNICAL FIELD OF THE INVENTION

The invention relates to a method for controlling a piezo-actuated fuel-injection valve.

DESCRIPTION OF THE RELATED ART

The fuel injection procedure in diesel engines is normally carried out in several stages, with one or more advanced injections or afterinjections being associated with each main injection, with the amount of injected fuel being small compared with the amount for the main injection, to achieve a smooth combustion characteristic.

For a precise dosing of the fuel quantities, particularly the small amounts and for optimization of the injection timepoints, fast-switching valves are necessary, with piezo-actuated fuel-injection valves being increasingly used.

Because of the small maximum longitudinal variation of the piezo-elements (stacks) used, the piezo actuator operates a hydraulic servo-valve that then moves the main valve. By means of an electronic control device, the electrical control of the piezo actuator is performed in such a way that the required fuel quantity is injected.

Because it is not possible to detect fuel quantities or mechanical movements in the injection valve, the duration of application and the amplitude of the electrical control signals during the injection of small amounts of fuel are designed so that a reliable injection takes place. Because of safety reservations with regard to pressure fluctuations in the fuel supply line, parameter tolerances of the system and the wide operating temperature range, fuel quantity overdosing is therefore entailed, particularly during advanced injection and afterinjection. Up to now, inference was drawn for this purpose from the charge fed to the piezo actuator or energy exerted on the piezo-actuation.

From DE 196 44 521 A1, a method is known for controlling a capacitive correcting element of a fuel-injection valve, whereby an energy quantity allocated to this stroke is applied to achieve a constant stroke.

SUMMARY OF THE INVENTION

The object of the invention is to provide a method, by means of which it is possible to determine whether advanced injection, main injection or afterinjection of the fuel is taking place and that also enables a more accurate determination of the amount of fuel in each advanced injection, main injection and afterinjection.

The object can be achieved by a method for control of a piezo-actuated fuel-injection valve during advanced, main or after injection, by means of a piezo actuator and a servo-valve actuated by same, to detect an opening of the servo-valve and determine the injection duration, comprising the steps of:

during a control operation, using the current applied to the piezo actuator and the voltage which is consequently established therefrom for calculating, with the help of a non-linear actuator model, the characteristics of the longitudinal variations and the force exerted by the actuator, and determining the beginning of the opening of the servo-valve and the duration of injection with said calculation or variables derived therefrom.

The object can also be achieved by a method for control of a piezo-actuated fuel-injection valve comprising the steps of:

applying a current a piezo actuator;

determining a voltage derived from said piezo actuator, calculating from said voltage the characteristics of longitudinal variations and a force exerted by the actuator, and determining the beginning of the opening of the servo-valve and the duration of injection with said calculation or variables derived therefrom.

The calculation can be performed with a non-linear actuator model. A first and second time window can be provided, the variations in longitude at the start and end of the first time window can determine a first tangent, and the variations in longitude at the start and at the end of the second time window can determine a second tangent and wherein both tangents intersect at a timepoint. The timepoint can be assessed as the opening point of the servo-valve if the tangent has a definably steeper angle compared with the abscissa than the tangent, and otherwise a faulty injection can be detected. At a timepoint assessed as the opening timepoint of the servo-valve, a tolerance band between an upper limit and a lower limit can be specified for the first time derivation of force, and the time in which the value of the first derivation moves within this tolerance band after timepoint can be assessed as the injection duration. The timepoints defining both time windows or the limits of the tolerance band can be stored in maps as timepoints allocated at least to the energy applied to the piezo actuator, the fuel pressure in the rail or the actuator temperature. The timepoints, stored in the maps, that determine the time windows can also be adapted relative to the timepoint determined in the particular proceeding earlier injection operation.

The method in accordance with the invention is based on the detection and assessment, with the aid of a non-linear actuator model, of the longitudinal variations of, and the forces exerted by, the piezo actuator from the electrical signals (of the current applied to the piezo actuator and the voltage established therefrom) during a control input, and on an adaptive method for evaluating the variations in longitude at the piezo actuator and in the forces occurring on it.

The actuator model contains the non-linear relationships between load, voltage and mechanical deflection, and also parameters relative to the working point. The actuator model also takes account of the dielectric hysteresis of the piezo actuator. This enables the actuator model to draw conclusions regarding the mechanical variables from the electrical variables and the simulation of the piezo actuator in the area of pulse-type deflection.

It is thus possible to reliably determine a faulty or correct injection function and the duration (amount) of injection of the injection valve and to adapt the control signals so that the required minimum fuel injection takes place without overdosing.

BRIEF DESCRIPTION OF THE DRAWINGS

An exemplary embodiment in accordance with the invention is explained in more detail in the following with the aid of schematic drawings.

The drawings are as follows:

FIG. 2—The force F acting on a piezo actuator during an opening operation of the valve with or without fuel injection, and the resulting variables.

DETAILED DESCRIPTION OF THE PREFERRED EMBODIMENTS

Figures 1, 2A, 2B:
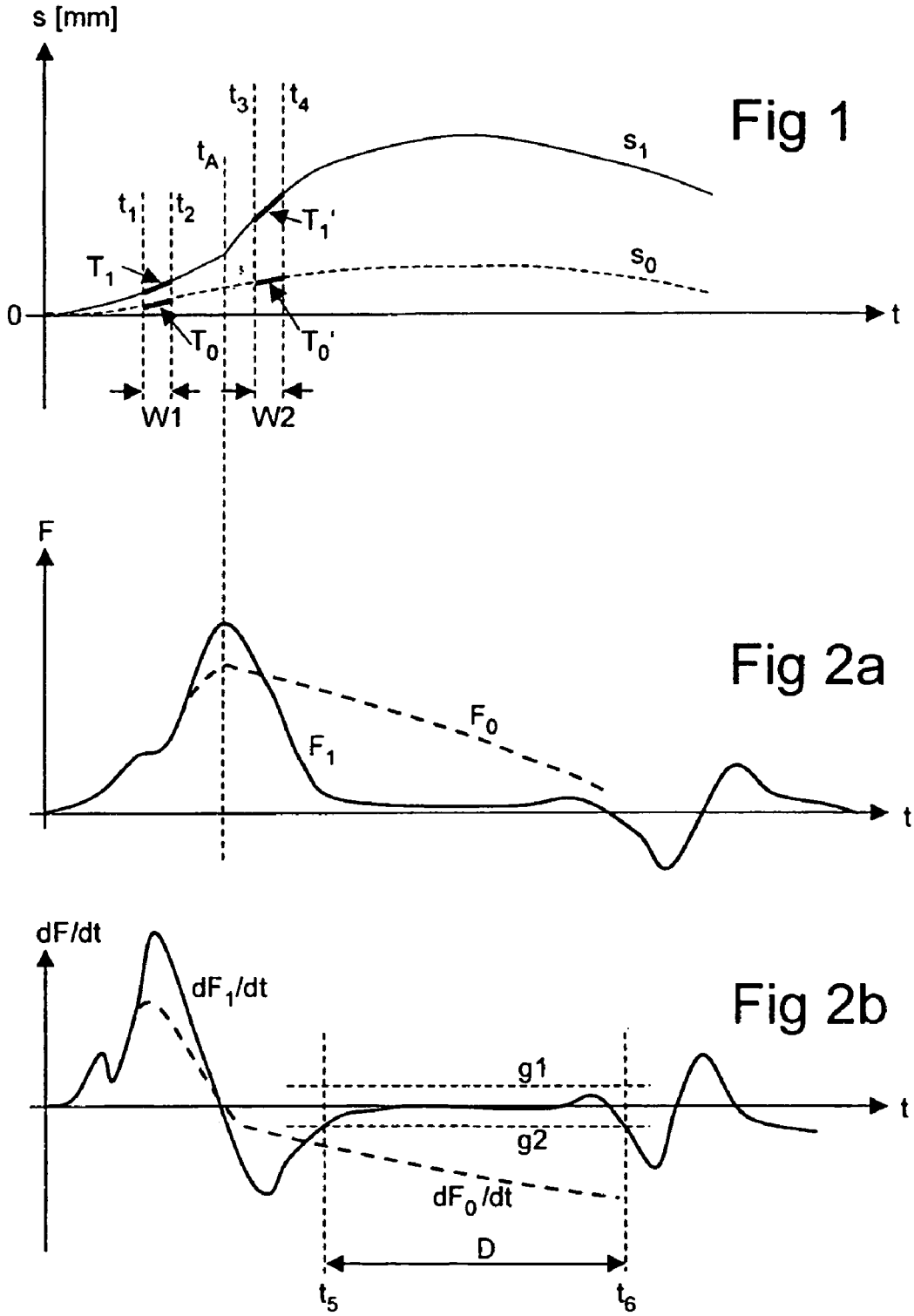
FIG. 1—Longitudinal variation s of a piezo actuator during a control operation.

FIG. 1 shows the basic pattern of the piezo stroke, i.e. the longitudinal variations s of a piezo actuator over time t during a control operation of a fuel injection valve. This longitudinal variation s is calculated by means of the measured data of the current applied to the piezo actuator and the increase in voltage resulting therefrom, with the aid of an actuator model that simulates the properties of a piezo actuator. The curve $s_1$ shows the main pattern of the start of the longitudinal variation s (expansion) of a piezo actuator during a corrective injective operation. The curve rises from the beginning 0 of the control input, shows a kink at timepoint $t_A$ and then increases faster until it reaches a maximum and then drops. The kink is due to the fact that the piezo actuator covers a lost motion before it meets the force of the rail pressure in the servo-valve and the servo-valve opens.

The dotted curve so shows, to differentiate from curve $s_1$, the main pattern of the beginning of the longitudinal variation (expansion) of a piezo actuator during an incorrect injection operation. The curve increases as a flat curve without showing a kink, reaches a maximum and then drops again, i.e. the lost motion is not entirely measured. The maximum of the curve of the longitudinal expansion of a piezo actuator depends mainly on the energy applied to the piezo actuator, i.e. the greater the amount of energy the greater the longitudinal expansion s.

The beginning of the opening of the servo-valve therefore lies approximately at timepoint $t_A$ of the curve $s_1$. This opening of the servo-valve is an absolute precondition for a succeeding injection. The actual injection takes place with a distinct delay because as the servo-valve opens the pressure in the valve chamber slowly reduces and only then does the actual injection valve open. The presence of the "kink" in the travel is an indication that there is sufficient energy in the piezo to open the servo-valve.

The method in accordance with the invention for determining the opening timepoint $t_A$ of the servo-valve is explained in the following. The timepoint $t_A$ varies, for example, according to the energy E applied to the piezo actuator and the fuel pressure in the rail p acting against it, and also the actuator temperature T, etc. It is thus empirically known.

By means of maps that take account of these relationships, a first time window W1 (determined by timepoints $t_1$ and $t_2$) just before timepoint $t_A$ [$t_A$=f(E, p, T . . . )] and a second time window W2 (determined by timepoints $t_3$ and $t_4$) just after this timepoint $t_A$ are defined.

A first straight-line—tangent $t_1$—is determined by the longitudinal variations at timepoints $t_1$ and $t_2$ and a second straight-line—tangent $T_1$'—is determined by the variations in longitude at timepoints $t_3$ and $t_4$. Both these tangents, shown in bold in FIG. 1, intersect at a timepoint $t_A$, that can be determined by means of a simple trigonometrical calculation, that is assessed as the timepoint of the opening of the servo-valve. For a correct injection, however, only a pattern of longitudinal variation s is assessed that at tangent $T_1$' has a definably steeper angle compared with the abscissa than tangent $T_1$. Otherwise, a faulty injection is assumed ($T_0$–$T_o$').

Due to wear, the position of timepoint $t_A$ can shift over a long period. Therefore, it is provided that timepoints t1 to t4, that determine time windows W1 and W2, stored in the maps are also stored relative, i.e. adapted, to the timepoint $t_A$ determined in the preceding earlier injection operation.

A determination of the injection duration takes place only if a correct injection with a defined start of injection was determined beforehand.

The fuel injection duration D is determined by means of the force F acting on the piezo actuator. This force F is determined, as the longitudinal variation s, from the electrical signals (from the current applied to the piezo actuator and the increase in voltage resulting therefrom), with the aid of the non-linear actuator model already mentioned.

FIG. 2*a* shows the main pattern of the force $F_1$ acting on a piezo actuator during a fuel injection operation or during a faulty injection ($F_0$, shown dotted).

The force F rises at the start of the control operation and reaches its maximum approximately at timepoint $t_A$, then changes to an approximately horizontal pattern (in the event of a faulty injection it reduces slowly) and on shutoff first jumps to the negative and then jumps to the positive, before it again becomes zero.

The first time derivation $dF_1/dt$ of the force F is used in accordance with the invention to determine the injection duration D. The pattern of the first derivation $dF_1/dt$ of the force F (FIG. 2*a*) is schematically illustrated in FIG. 2*b*.

With a correct injection operation, this derivation $dF_1/dt$ reaches its maximum da where the force $F_1$ rises most steeply, then becomes negative when the force drops off and reaches a plateau around the value zero da where the force $F_1$ has a horizontal pattern, before it first becomes negative on shut-off, and then positive finally goes to zero.

In the event of a faulty injection, the derivation $dF_0/dt$ (shown dotted in FIG. 2*b*) would reach a lower maximum and then become negative before it again goes to zero at shut-off.

In accordance with the invention, a tolerance band for the value of the first derivation is placed in the area of the aforementioned plateau, with an upper value g1 (for positive dF/dt) and a lower value g2 (for negative dF/dt). Both these values are shown dotted in FIG. 2*b*. These values can also, as in windows W1 and W2 in FIG. 1, be varied by means of maps relative to the applied energy, pressure in the rail, etc.

As long as the first derivation $dF_1/dt$, after timepoint $t_A$, is within this tolerance band, determined between timepoints $t_5$ and $t_6$ in FIG. 2*b*, it is assumed that the fuel injection, that in any case takes place with a time offset, has duration D ($D=t_6-t_5$).

In the manner described, it can be determined for each control input of a piezo actuator, for advanced, main or afterinjection, whether a correct or faulty injection takes place, when the injection begins and how long it persists.

We claim:

1. A method for control of a piezo-actuated fuel-injection valve during advanced, main or after injection, by means of a piezo actuator and a servo-valve actuated by same, to detect an opening of the servo-valve and determine the injection duration, comprising the steps of:

during a control operation, using the current applied to the piezo actuator and the voltage which is consequently established therefrom for calculating, with the help of a non-linear actuator model, the characteristics of the longitudinal variations and the force exerted by the actuator, and determining the beginning of the opening of the servo-valve and the duration of injection with said calculation or variables derived therefrom.

2. The method in accordance with claim 1, wherein a first and second time window are provided, the variations in longitude at the start and end of the first time window determine a first tangent, and the variations in longitude at the start and at the end of the second time window determine a second tangent and wherein both tangents intersect at a timepoint.

3. The method in accordance with claim 2, wherein the timepoint is assessed as the opening point of the servo-valve if the tangent has a definably steeper angle compared with the abscissa than the tangent, and otherwise a faulty injection is detected.

4. The method in accordance with claim 1, wherein at a timepoint assessed as the opening timepoint of the servo-valve, a tolerance band between an upper limit and a lower limit is specified for the first time derivation of force, and the time in which the value of the first derivation moves within this tolerance band after timepoint is assessed as the injection duration.

5. The method in accordance with claim 2, wherein the timepoints defining both time windows or the limits of the tolerance band are stored in maps as timepoints allocated at least to the energy applied to the piezo actuator, the fuel pressure in the rail or the actuator temperature.

6. The method in accordance with claim 4, wherein the timepoints defining both time windows or the limits of the tolerance band are stored in maps as timepoints allocated at least to the energy applied to the piezo actuator, the fuel pressure in the rail or the actuator temperature.

7. The method in accordance with claim 5, wherein the timepoints, stored in the maps, that determine the time windows are also adapted relative to the timepoint determined in the particular proceeding earlier injection operation.

8. The method in accordance with claim 6, wherein the timepoints, stored in the maps, that determine the time windows are also adapted relative to the timepoint determined in the particular proceeding earlier injection operation.

9. The method in accordance with claim 1, wherein the calculation is performed with a non-linear actuator model.

10. A method for control of a piezo-actuated fuel-injection valve comprising the steps of:

applying a current a piezo actuator;

determining a voltage derived from said piezo actuator, calculating from said voltage the characteristics of longitudinal variations and a force exerted by the actuator, and determining the beginning of the opening of the servo-valve and the duration of injection with said calculation or variables derived therefrom.

11. The method in accordance with claim 10, wherein a first and second time window are provided, the variations in longitude at the start and end of the first time window determine a first tangent, and the variations in longitude at the start and at the end of the second time window determine a second tangent and wherein both tangents intersect at a timepoint.

12. The method in accordance with claim 11, wherein the timepoint is assessed as the opening point of the servo-valve if the tangent has a definably steeper angle compared with the abscissa than the tangent, and otherwise a faulty injection is detected.

13. The method in accordance with claim 10, wherein at a timepoint assessed as the opening timepoint of the servo-valve, a tolerance band between an upper limit and a lower limit is specified for the first time derivation of force, and the time in which the value of the first derivation moves within this tolerance band after timepoint is assessed as the injection duration.

14. The method in accordance with claim 11, wherein the timepoints defining both time windows or the limits of the tolerance band are stored in maps as timepoints allocated at least to the energy applied to the piezo actuator, the fuel pressure in the rail or the actuator temperature.

15. The method in accordance with claim 13, wherein the timepoints defining both time windows or the limits of the tolerance band are stored in maps as timepoints allocated at least to the energy applied to the piezo actuator, the fuel pressure in the rail or the actuator temperature.

16. The method in accordance with claim 14, wherein the timepoints, stored in the maps, that determine the time windows are also adapted relative to the timepoint determined in the particular proceeding earlier injection operation.

17. The method in accordance with claim 15, wherein the timepoints, stored in the maps, that determine the time windows are also adapted relative to the timepoint determined in the particular proceeding earlier injection operation.

* * * * *